US010193280B2

(12) United States Patent
Sutter et al.

(10) Patent No.: US 10,193,280 B2
(45) Date of Patent: Jan. 29, 2019

(54) CONNECTOR WITH BI-DIRECTIONAL LATCH

(71) Applicant: Molex, LLC, Lisle, IL (US)

(72) Inventors: Steven George Sutter, Maumelle, AR (US); Darian Schulz, Little Rock, AR (US); Kent E. Regnier, Lombard, IL (US)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/823,177

(22) Filed: Nov. 27, 2017

(65) Prior Publication Data

US 2018/0083390 A1 Mar. 22, 2018

Related U.S. Application Data

(63) Continuation of application No. 15/202,103, filed on Jul. 5, 2016, now Pat. No. 9,831,610, which is a (Continued)

(51) Int. Cl.

| | |
|---|---|
| ***H01R 13/627*** | (2006.01) |
| ***H01R 13/6473*** | (2011.01) |
| ***H01R 24/62*** | (2011.01) |
| ***H01R 12/70*** | (2011.01) |
| ***H01R 13/6471*** | (2011.01) |
| ***H01R 24/60*** | (2011.01) |

(Continued)

(52) U.S. Cl.

CPC ..... *H01R 13/6473* (2013.01); *H01R 12/7076* (2013.01); *H01R 13/6272* (2013.01); *H01R 13/6273* (2013.01); *H01R 13/6275* (2013.01); *H01R 13/6471* (2013.01); *H01R 13/6582* (2013.01); *H01R 24/60* (2013.01); *H01R 24/62* (2013.01); *H01R 2107/00* (2013.01)

(58) Field of Classification Search

CPC ..... H01R 13/6271; H01R 13/6272; H01R 13/6273; H01R 13/6275; H01R 13/6471; H01R 13/6473; H01R 13/6582; H01R 12/706; H01R 24/606; H01R 24/6212

USPC ..... 439/352

See application file for complete search history.

(56) References Cited

U.S. PATENT DOCUMENTS

| | | | |
|---|---|---|---|
| 5,066,236 | A | 11/1991 | Broeksteeg |
| 5,622,522 | A | 4/1997 | Tan et al. |

(Continued)

FOREIGN PATENT DOCUMENTS

| | | | |
|---|---|---|---|
| CN | 1494752 | A | 5/2004 |
| CN | 200950492 | Y | 9/2007 |

(Continued)

*Primary Examiner* — Chandrika Prasad

(74) *Attorney, Agent, or Firm* — Jeffrey K. Jacobs

(57) ABSTRACT

A connector can include a housing and a conductive shield and a pair of latching members. The latching members have free ends with engagement teeth formed on them which are separated by an intervening notch. The sidewalls of this notch can be flat and can define a hard stop surface for engagement with an opposing board connector. The free ends further include ramped surfaces leading to the engagement notch to form cam surfaces that depress the latching members when the cable connector is mated to a board connector. The latching members may include locating tabs that are captured in vertical movement by the housing.

20 Claims, 10 Drawing Sheets

Related U.S. Application Data continuation of application No. 14/761,358, filed as application No. PCT/US2014/011852 on Jan. 16, 2014, now Pat. No. 9,397,442.

(60) Provisional application No. 61/753,029, filed on Jan. 16, 2013, provisional application No. 61/757,299, filed on Jan. 28, 2013, provisional application No. 61/760,433, filed on Feb. 4, 2013, provisional application No. 61/868,704, filed on Aug. 22, 2013.

(51) Int. Cl.
*H01R 13/6582* (2011.01)
*H01R 107/00* (2006.01)

(56) References Cited

U.S. PATENT DOCUMENTS 5,934,942 A 8/1999 Patel et al.
5,959,848 A 9/1999 Groves et al.
6,352,444 B1 3/2002 Yuzawa
6,659,796 B1 12/2003 Waddell et al.
6,786,755 B2 * 9/2004 Dambach ..... H01R 13/6273 439/353
6,854,992 B2 2/2005 Martin et al.
6,948,965 B2 9/2005 Kumamoto et al.
7,175,465 B1 2/2007 Tsai
7,192,297 B1 3/2007 Wu
7,232,345 B2 * 6/2007 Ishizuka ..... H01R 13/6471 439/660
7,252,540 B2 8/2007 Tanaka
7,322,845 B2 1/2008 Regnier et al.
7,351,103 B1 4/2008 Peng et al.
7,354,292 B1 4/2008 Lloyd et al.
7,438,565 B2 10/2008 Hamazaki
7,654,846 B2 2/2010 Kimura et al.
7,766,680 B2 8/2010 Suzuki et al.
7,824,222 B2 11/2010 Miyoshi et al.
7,845,982 B1 12/2010 Wang
8,011,969 B2 9/2011 Wang et al.
8,038,480 B2 10/2011 Wei
8,100,709 B2 1/2012 Zhang
8,478,536 B2 7/2013 Wang et al.
8,622,767 B2 1/2014 Nakazura et al.
8,668,515 B2 3/2014 Wu
8,961,235 B2 2/2015 Little et al.
8,992,262 B2 3/2015 Pang et al.
9,397,442 B2 * 7/2016 Sutter ..... H01R 24/62
9,831,610 B2 * 11/2017 Sutter ..... H01R 24/62
2003/0134529 A1 7/2003 Murr et al.
2003/0162446 A1 8/2003 Ho et al.
2004/0077196 A1 4/2004 Martin et al.
2006/0148300 A1 * 7/2006 Huang ..... H01R 13/6275 439/353
2007/0049100 A1 3/2007 Tsai
2007/0054553 A1 3/2007 Nishio et al.
2007/0072457 A1 3/2007 Hamazaki
2009/0004916 A1 1/2009 Miyoshi et al.
2009/0011624 A1 1/2009 Yamazaki
2010/0081303 A1 4/2010 Roth et al.
2010/0087084 A1 4/2010 George
2010/0158449 A1 6/2010 Yi
2011/0159744 A1 6/2011 Buck
2011/0269346 A1 11/2011 Casher et al.
2011/0294334 A1 12/2011 Phillips et al.
2012/0077365 A1 3/2012 Kobayashi et al.
2012/0156941 A1 6/2012 Wu
2012/0190223 A1 7/2012 Wu
2012/0225583 A1 9/2012 Kamarauskas et al.
2012/0238146 A1 9/2012 Liao et al.
2012/0322306 A1 12/2012 Tai et al.
2013/0288540 A1 10/2013 Cheng
2014/0030899 A1 1/2014 Crighton et al.
2015/0126069 A1 * 5/2015 Little ..... H01R 24/60 439/607.55

FOREIGN PATENT DOCUMENTS

CN 201402882 Y 10/2010
CN 202145500 U 2/2012
JP 10-302893 A 11/1998
JP 2000-068007 A 3/2000
JP 2009-059853 A 3/2009
TW M349108 U 1/2009
TW M364338 U 9/2009
WO WO 2004-030158 A2 4/2004
WO WO 2007-039039 A1 4/2007
WO WO 2014-113563 A1 7/2014

* cited by examiner

CONNECTOR WITH BI-DIRECTIONAL LATCH

REFERENCE TO RELATED APPLICATIONS

This application claims priority to U.S. application Ser. No. 15/202,103, filed Jul. 5, 2016, now U.S. Pat. No. 9,831,610, which in turn claims priority to U.S. application Ser. No. 14/761,358, filed Jul. 16, 2015, now U.S. Pat. No. 9,397,442, which is a national phase of PCT Application No. PCT/US2014/011852, filed Jan. 16, 2014, which in turn claims priority to prior-filed U.S. Provisional Patent Application No. 61/753,029, entitled "IO Connector," filed on 16 Jan. 2013; 61/757,299, entitled "Low Profile Connection System," filed on 28 Jan. 2013; 61/760,433, entitled "Low Connector Profile System," filed on 4 Feb. 2013; and 61/868,704, entitled "Bi-Directional Latch," filed on 22 Aug. 2013, each of which is incorporated herein by reference in its entirety.

Additionally, this application is related to PCT Patent Application No. PCT/US2014/011838 (Molex Internal Reference No. B2-226 WO), entitled "Low Profile Connector System," filed on 16 Jan. 2014 and having the same inventors as the Present Disclosure and assigned to the same Assignee as the Present Disclosure.

BACKGROUND OF THE DISCLOSURE

The present disclosure relates generally to electrical connectors and more particularly, to connectors of small size with improved latching mechanisms.

It is important to have adequate connector wipe in connectors of small size in order to ensure proper and reliable contact between the terminals of two opposing, interengaging connectors. Current connectors available in the marketplace rely upon many different components in order to define the necessary hardstops that ensure proper mating between the two connectors. Additionally, because the desired current connector environment is very small, the incorporation of active latching mechanisms presents challenges for the designer establishing reliable tolerances.

The present disclosure is therefore directed to an improved latching mechanism that is particularly suitable for use in connectors of small pitch that reliably capture a latching member in its latching movement to reduce deflection thereof, so that the mating with an opposing connector is more reliable, which latching member includes a pair of opposing hardstops to maintain engagement with the opposing mating connector and actuating surfaces that are configured to move the latching member out of an into engagement with an opposing connector during mating.

SUMMARY OF THE PRESENT DISCLOSURE

Accordingly, there is provided an improved latching mechanisms which is suitable for use in connectors of small pitch and which provides bidirectional characteristics and reliable engagement.

In accordance with one embodiment as described in the following disclosure, a cable connector is provided with a connector body including a plurality of conductive terminals to which wires of the cable are terminated. The terminals extend lengthwise, or axially, within the connector housing and are supported on a connector body in a position for mating with like corresponding terminals of an opposing, mating connector. The cable connector includes a conductive outer shell that provides shielding to the terminals and a grounding aspect to the connector and this outer shell, or shroud encompasses the terminals and is received within a corresponding shield of the opposing connector, which is typically mounted to a circuit board. Two latching members are preferably associated with the cable connector body for engaging the opposing board connector.

The opposing board connectors have insulative body portions which support conductive terminals and the terminals are encompassed by an associated outer conductive shield. The latching members are secured on the cable connector body and extend in a cantilevered fashion so that free ends thereof define latching arms with engagement ends. Due to their cantilevered structure, the latching member free ends are free to deflect under loading. The latching members extend along opposite sides of the connector body and their free ends extend within the cable connector shield. The latching arms are preferably offset so that they can be actuated by pressing a portion of the connector housing, and their free ends received within the cable connector shield without interference. Portions of the latching member free ends project out through associated openings in the cable connector shield so as to provide engagement surfaces that engage the shield of the opposing board connector.

The latching members, according to the one embodiment of the disclosure, include engagement slots, or notches, which are formed in the free ends of the latching members. These engagement notches preferably extend vertically, or perpendicularly, to the longitudinal axes of the latching members. As such, the notches include associated pairs of latching teeth, or hooks, with the latching teeth including planar faces on opposite sides of the slots that define leading and trailing engagement surfaces configured to confront and engage opposing engagement surfaces formed in the shield of the opposing, mating board connector. In order to provide these engagement surfaces, the board connector shield preferably includes openings spaced rearwardly from the front edge thereof. The openings define intervening tabs, or locking bars, each of which includes two opposing engagement surfaces which confront the engagement surfaces of the latching teeth notch on the cable connector latching member free ends.

In order to provide the latching members with a bidirectional operation aspect, each latching member preferably includes a pair of ramped surfaces that extend in opposite directions, forwardly and rearwardly, from their associated engagement surfaces of the notches. The forward ramped surface will engage the front edge of the board connector shield and deflect the latching member free end downwardly as the cable connector is pushed forwardly into the board connector shield. The latching member free end then tracks the inside surface of the board connector shield until it encounters a corresponding opening in the board connector shield. It then springs upwardly so that its forward tooth extends into the opening and its notch contains the locking tab, or bar of the board connector shield. An actuation tab may be provided that extends into contact with the connector housing so that pressure on the connector housing depresses the latching members. The actuation tabs are positioned on the latching members at an elevation above the free ends thereof.

In another embodiment of the present disclosure, a means to capture the vertical movement of the latching members is provided. The latching member is provided, in this embodiment, with a vertical locating tab that preferably depends downwardly from a body of the latching member. The connector body includes a corresponding vertical slot into which the locating tab projects and in which, is free to move.

The locating tab thereupon is captured in the slot of the connector body and this structure prevents deflection of the latching members in the horizontal direction.

These and other objects, features and advantages of the present disclosure will be clearly understood through a consideration of the following detailed description.

BRIEF DESCRIPTION OF THE DRAWINGS

The organization and manner of the structure and operation of the disclosure, together with further objects and advantages thereof, may best be understood by reference to the following detailed description, taken in connection with the accompanying Figures, wherein like reference numerals identify like elements, and in which.

DETAILED DESCRIPTION OF THE DISCLOSURE

While the present disclosure may be susceptible to embodiment in different forms, there is shown in the Figures, and will be described herein in detail, specific embodiments, with the understanding that the disclosure is to be considered an exemplification of the principles of the present disclosure, and is not intended to limit the present disclosure to that as illustrated.

In the illustrated embodiments, directional representations—i.e., up, down, left, right, front, rear and the like, used for explaining the structure and movement of the various elements of the present disclosure, are relative. These representations are appropriate when the elements are in the position shown in the Figures. If the description of the position of the elements changes, however, it is assumed that these representations are to be changed accordingly.

Figure 1:
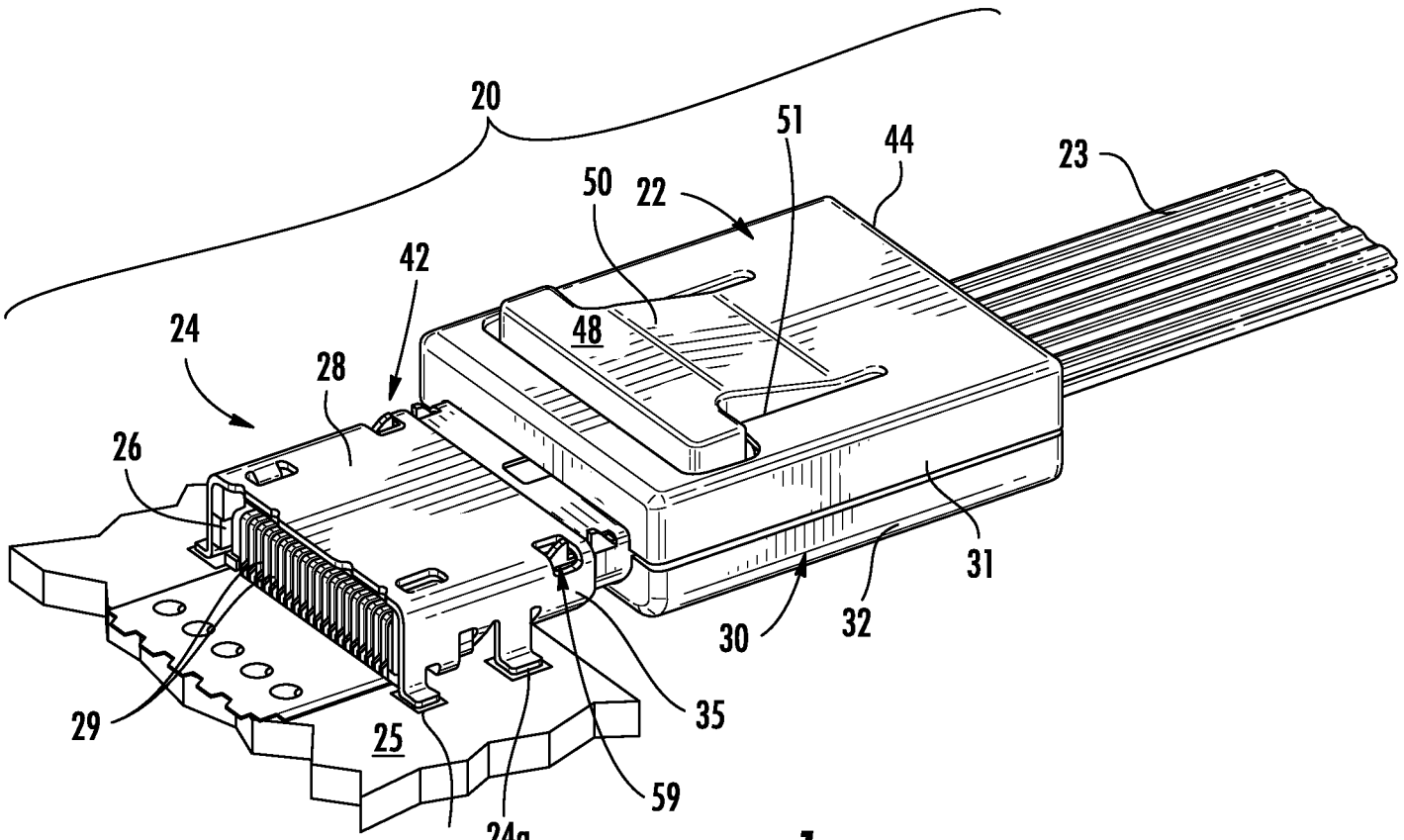
FIG. 1 is a perspective view of a mated connector assembly incorporating latching mechanisms constructed in accordance with the principles of the present disclosure.

FIG. 1 illustrates a connector assembly 20 constructed in accordance with the principles of the present disclosure and which utilizes a cable connector 22 and a circuit board connector 24 engaged in a mating condition. The cable connector 22 is used to connect a plurality of cable wires 23 to circuits on a circuit board 25 that may be housed within an electronic device (not shown). The board connector 24 has an insulative body, or housing 26 that supports a plurality of conductive terminals 29, tail portions 29*a* of which extend out of the rear of the connector housing 26 and contact portions of which (not shown) extend along the housing 26 within the hollow interior of an exterior grounding shield 28. The board connector 24 includes mounting feet 24*a* that may be attached to the circuit board by soldering to mounting pads 25*a* or by way of compliant pins or the like.

Figure 2:
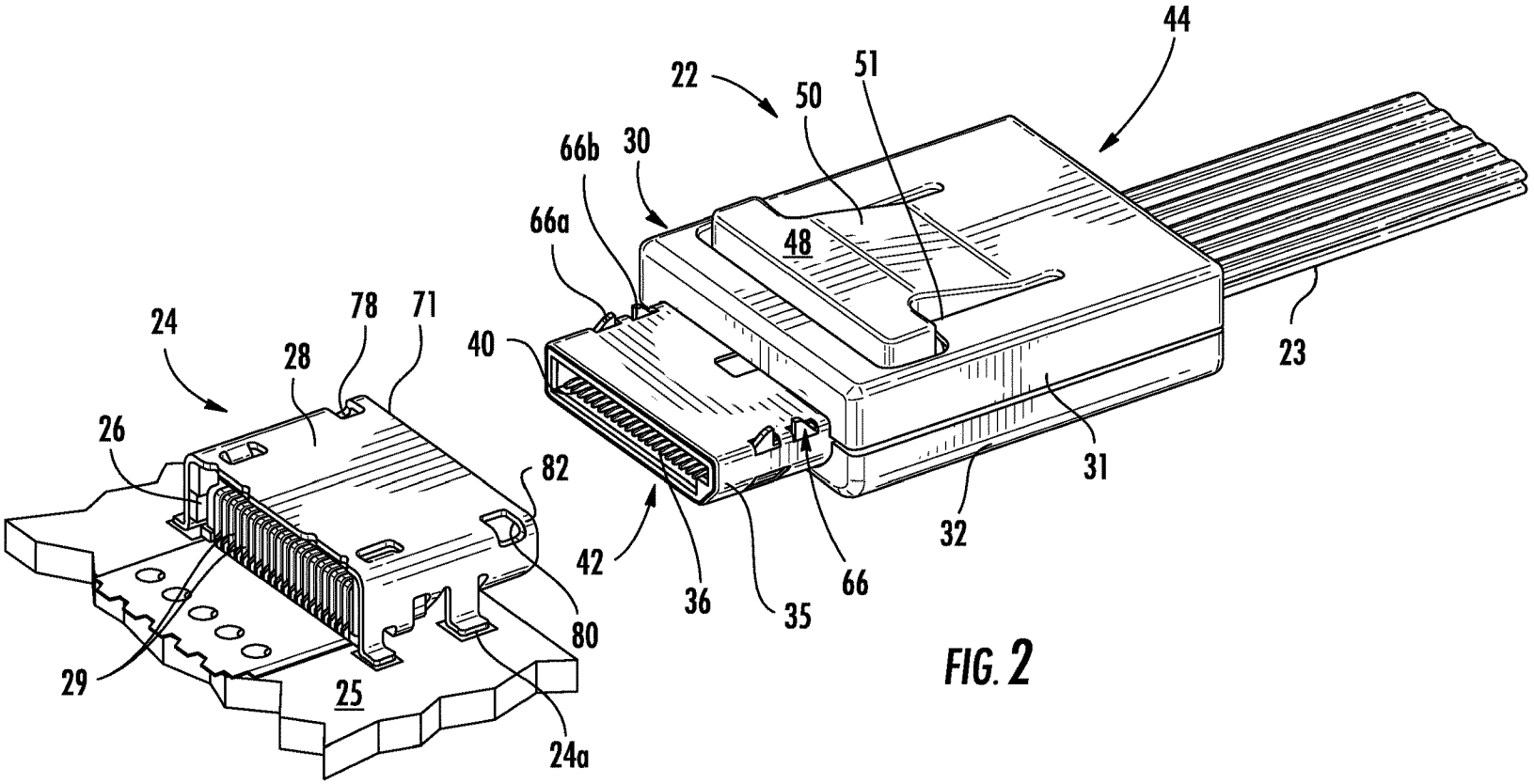
FIG. 2 is the same view as FIG. 1 but with the two opposing connectors illustrate din a unmated condition.
Figure 3:
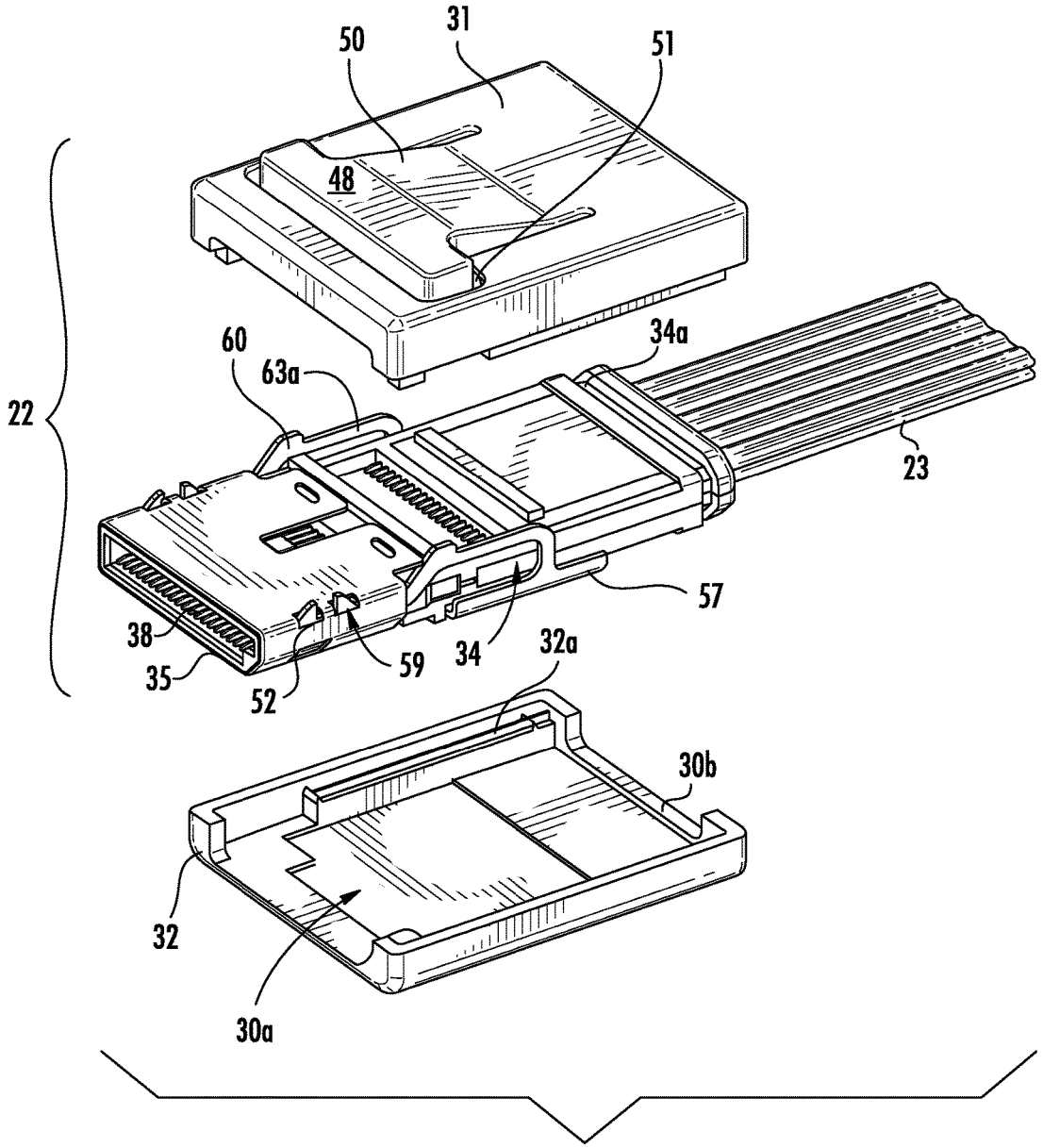
FIG. 3 is the same view as FIG. 2, but with the connector housing removed for clarity purposes.

As seen in FIG. 2, the cable connector 22 has an insulative connector housing 30 that is formed form two interengaging halves (FIG. 3) 31, 32 that cooperatively define a hollow interior 30*a* that houses a connector body 34 therein. The connector body 34 supports a plurality of conductive terminals 36 that have termination tails (not shown) and contact portions 38. The terminals 36 extend lengthwise of the connector body 34 and the connector body 34 includes a series of slots 40 disposed proximate a mating end 42 thereof, wherein each slot receives a portion of the terminal contact portions 38. These slots 40 permit the terminal contact portions 38 to deflect vertically under the insertion pressure of a mating blade of the opposing board connector 24 as is known in the art. The connector halves 31, 32 may include a ridge 30*b* disposed at their rear exit portions which are received in an opposing channel 34*a* defined at the rear end of the connector body 34 so that the housing 30 is properly and reliably engaged with the connector body 34.

The cable connector 22 is further provided with an actuation tab, or button, 48 that is disposed on the top surface of the housing half 31. The button is shown in the Figures as having an overall T-shape and it will be understood that other configurations may be used. The button 48 is shown formed integral with the connector housing half 31 and is partially separated therefrom by an intervening slit, or cut, 51 that outlines most of the T-shape of the actuation button 48, but is not continuous in nature so as to form a cantilevered support for the button 48. At least the bottom connector half 32 includes appropriately sized recesses that are aligned with the actuation button 48 and the lower beam portion 63*b* of the latching member 58 to permit the beam portion 63*b* to be depressed and return to its original position without interference with the connector housing 30.

A conductive shield, or shroud, 35 is provided and this shroud 35 fits over the mating end 42 of the connector body portion that supports the terminal contact portions 38. The shroud 35 has a hollow interior 35*a* and one or more openings 54 that may be stamped therein which engage raised bosses 53 formed on the connector body 34. The shroud provides a shield which is resistant to electromagnetic interference ("EMI") at the connector mating interface and also provides a first mate-last break ground contact for the cable connector 22. As illustrated, the shroud 35 includes a non-uniform configuration so that it may be inserted into the opposing board connector 24 in only the correct orientation. When the shroud 35 is attached to the connector body 34 it partially encloses the terminals 36 with a conductive shield, and has openings 52 formed in it that permit the latching teeth 66 of the cable connector latching members 56 to project therethrough as will be explained in more detail to follow.

Figure 4:
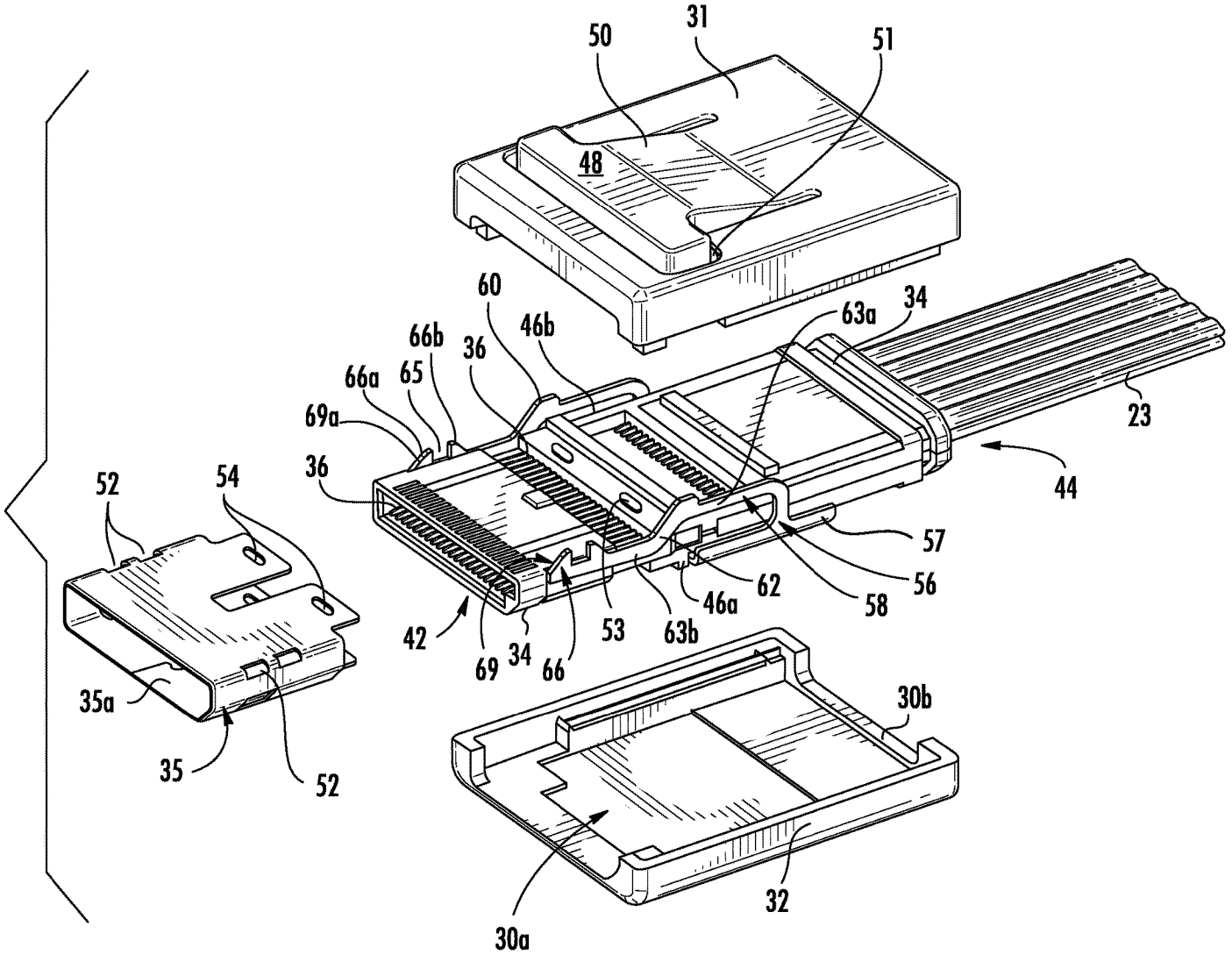
FIG. 4 is the same view as FIG. 3, but with the front shield shown removed from the connector body.
Figure 5:
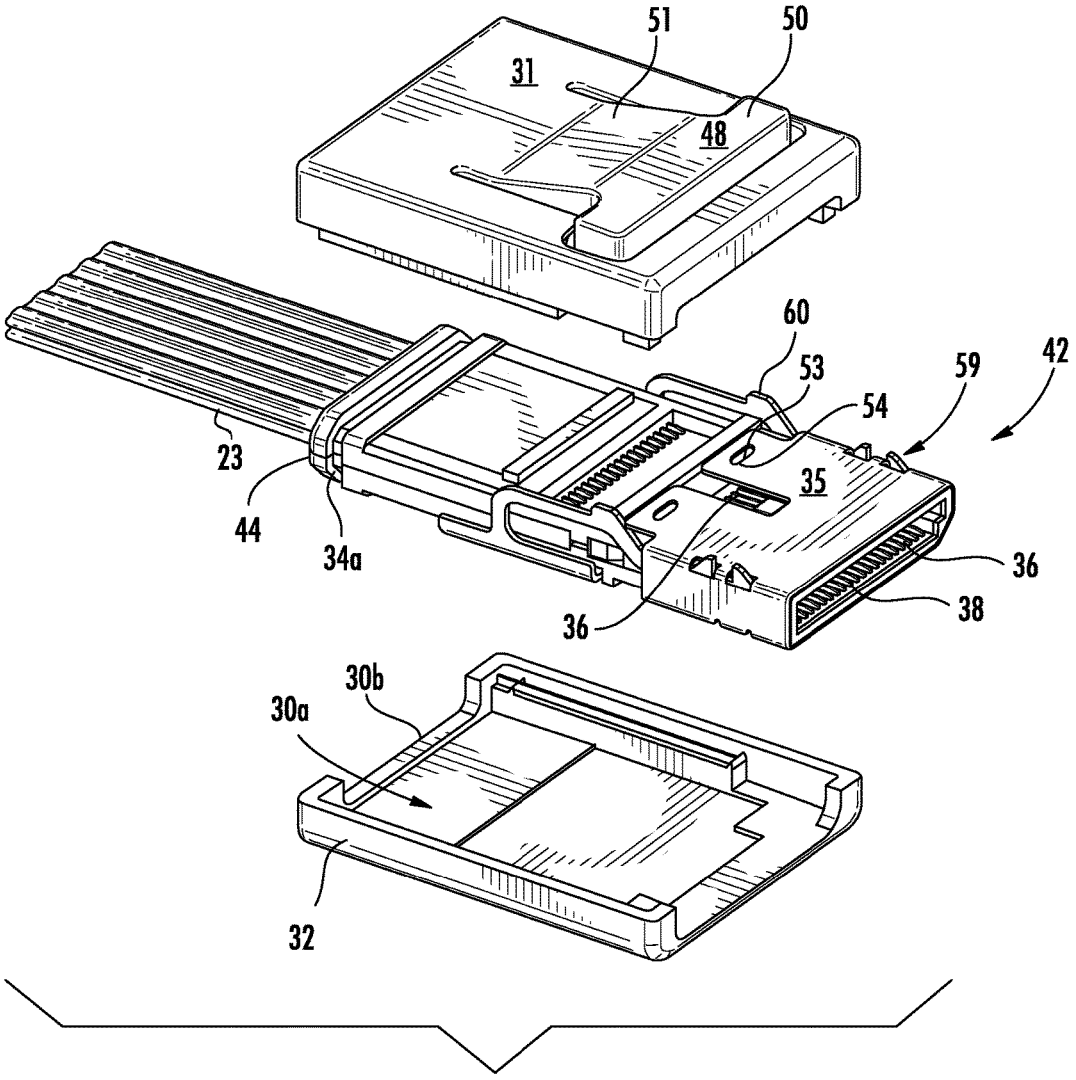
FIG. 5 is an exploded view of the cable connector from the opposite side of FIG. 1, with the connector housing removed to show the latching mechanism in place upon the connector body.
Figure 6:
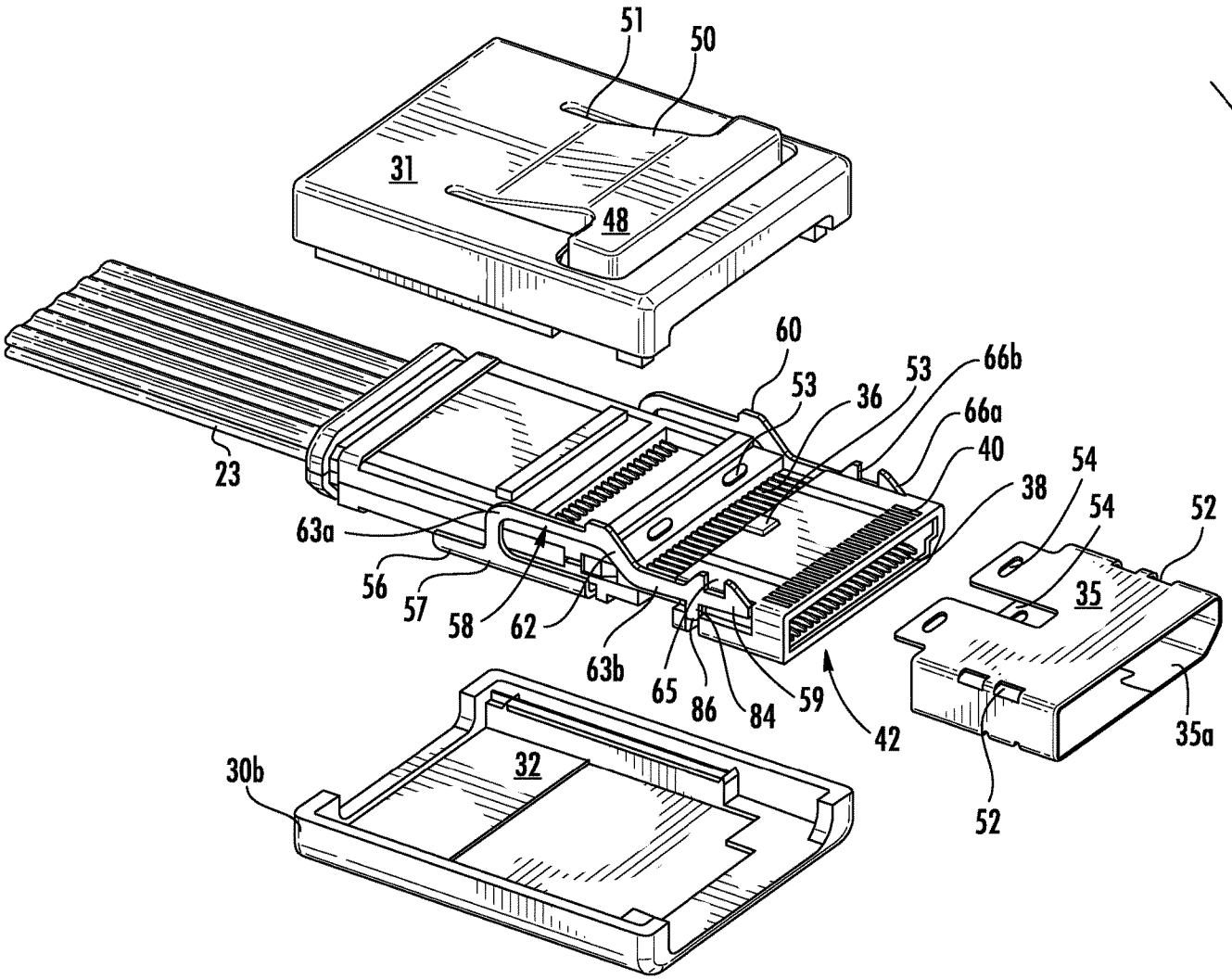
FIG. 6 is the same view as FIG. 5, but with the grounding shield removed to expose the free ends of the latching members to view.
Figure 7:
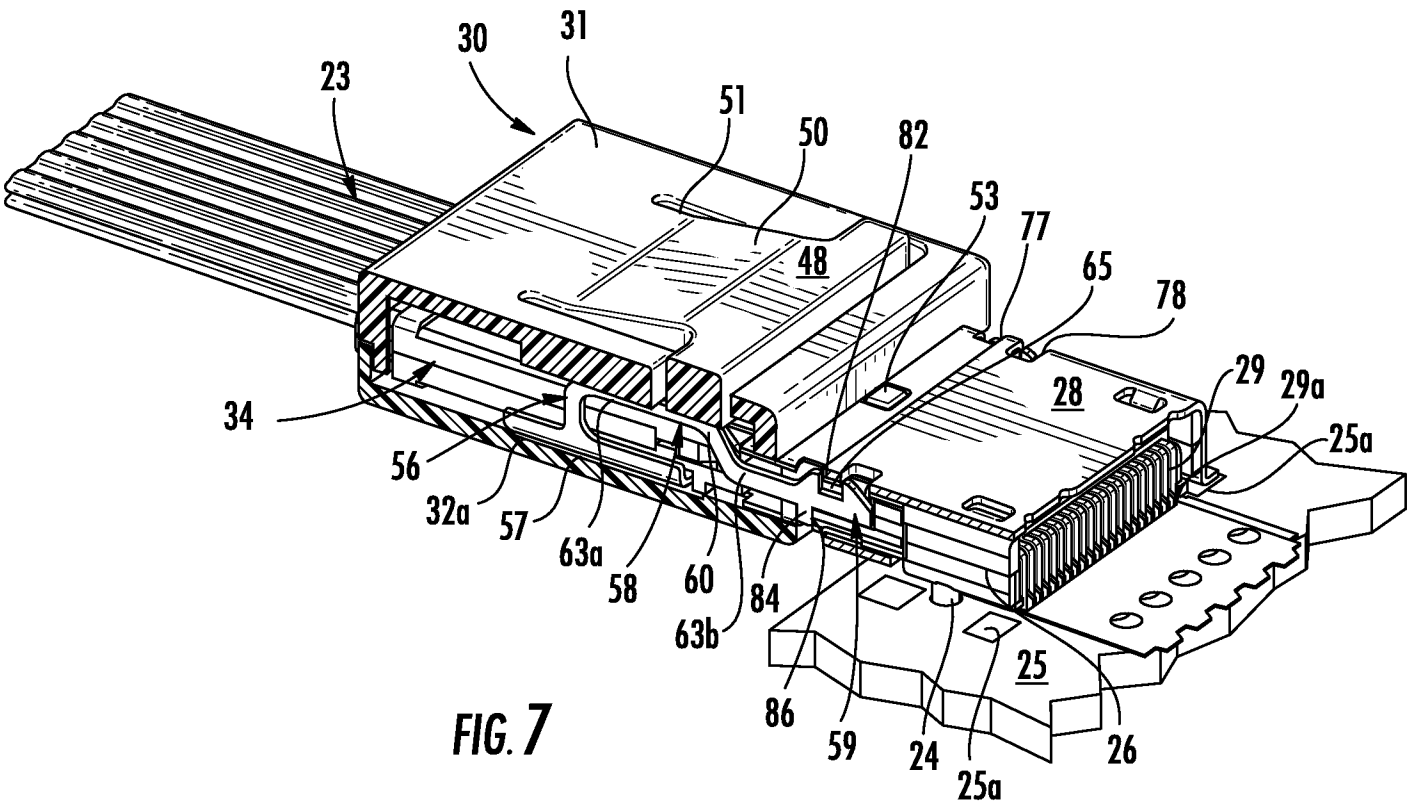
FIG. 7 is a sectional view of the connector assembly showing one latching member in a depressed condition.
Figure 8:
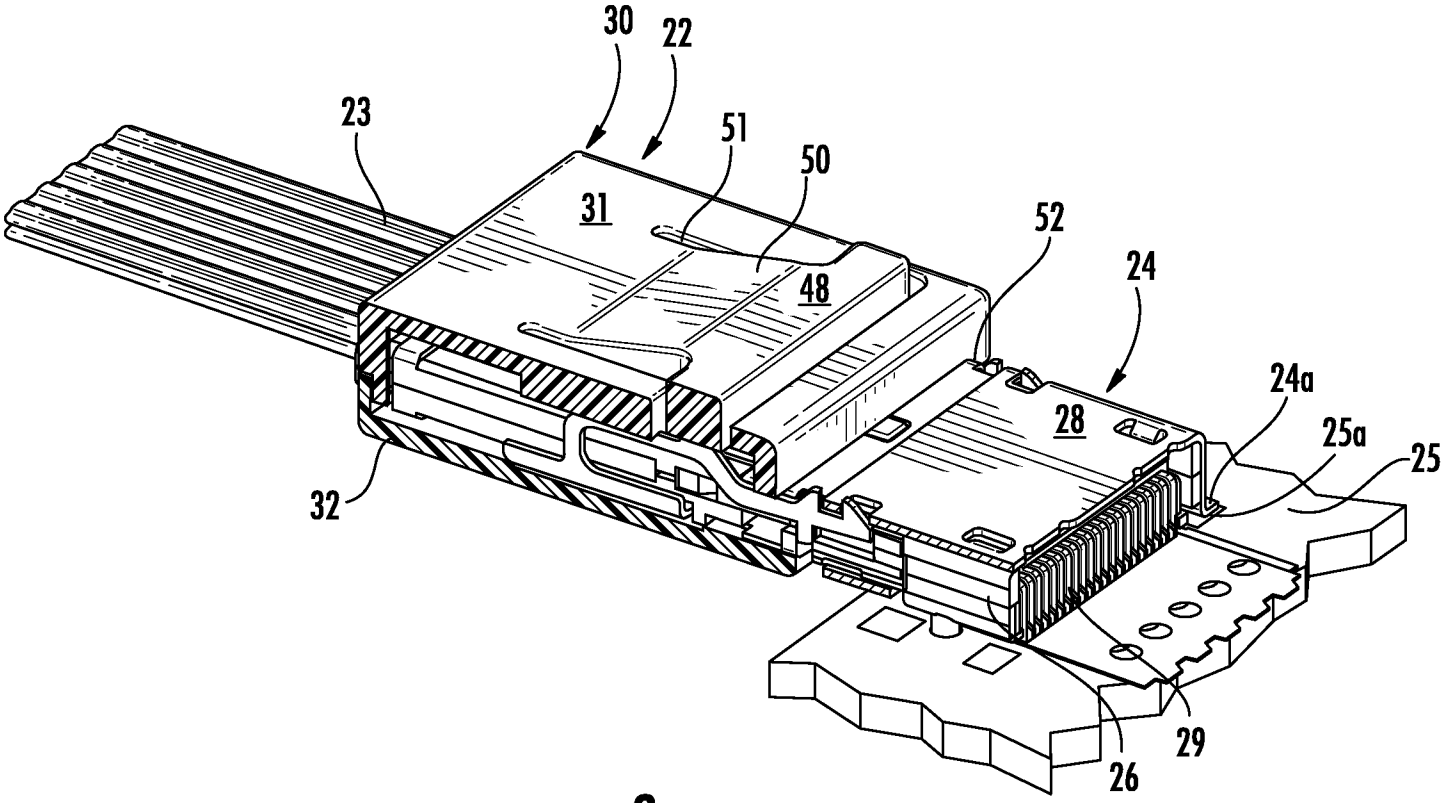
FIG. 8 is the same view as FIG. 7, but with the latching member extended upwardly into engagement with the shield of the board connector.
Figure 9:
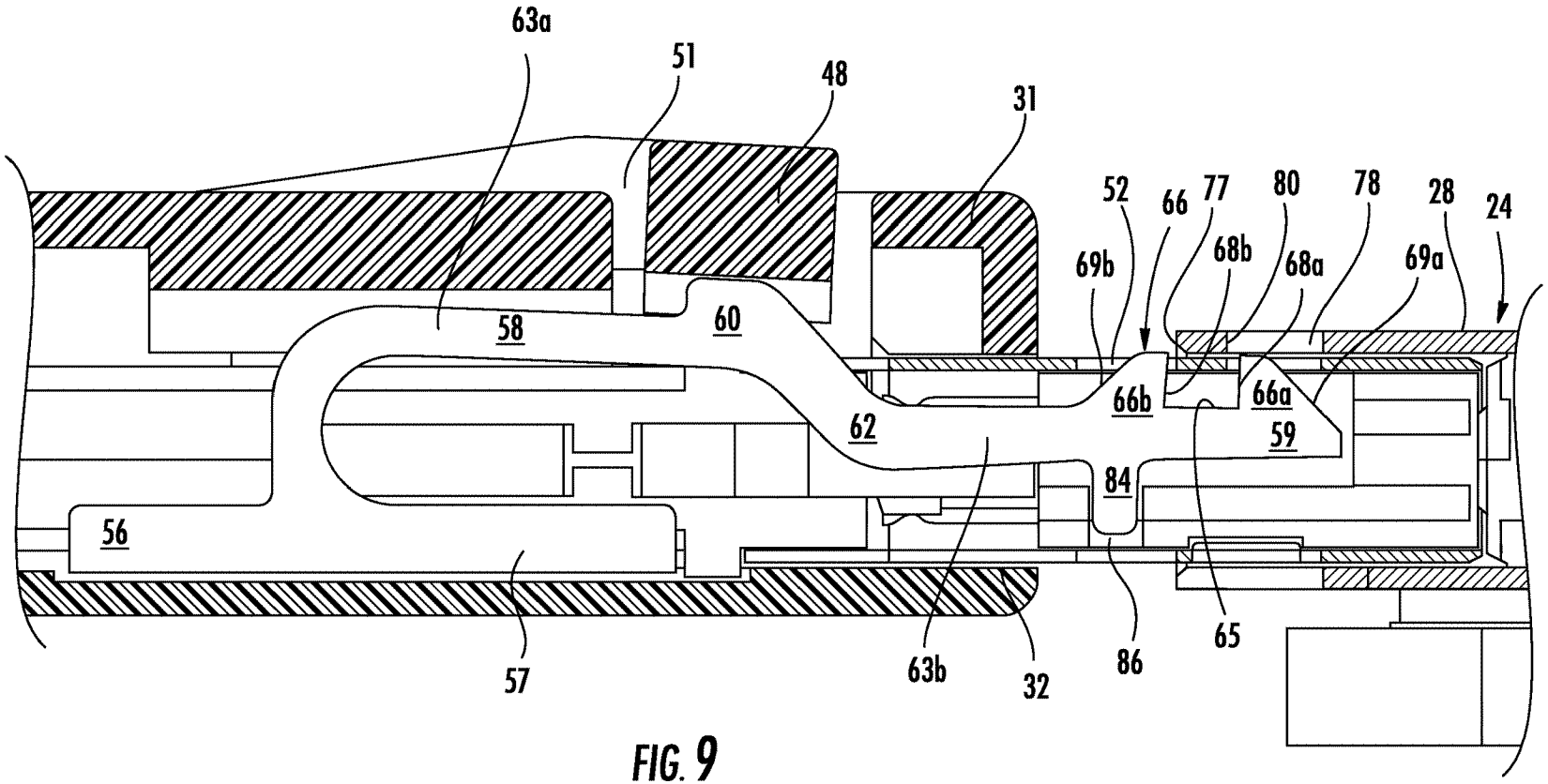
FIG. 9 is an enlarged detail view of FIG. 7.
Figure 10:
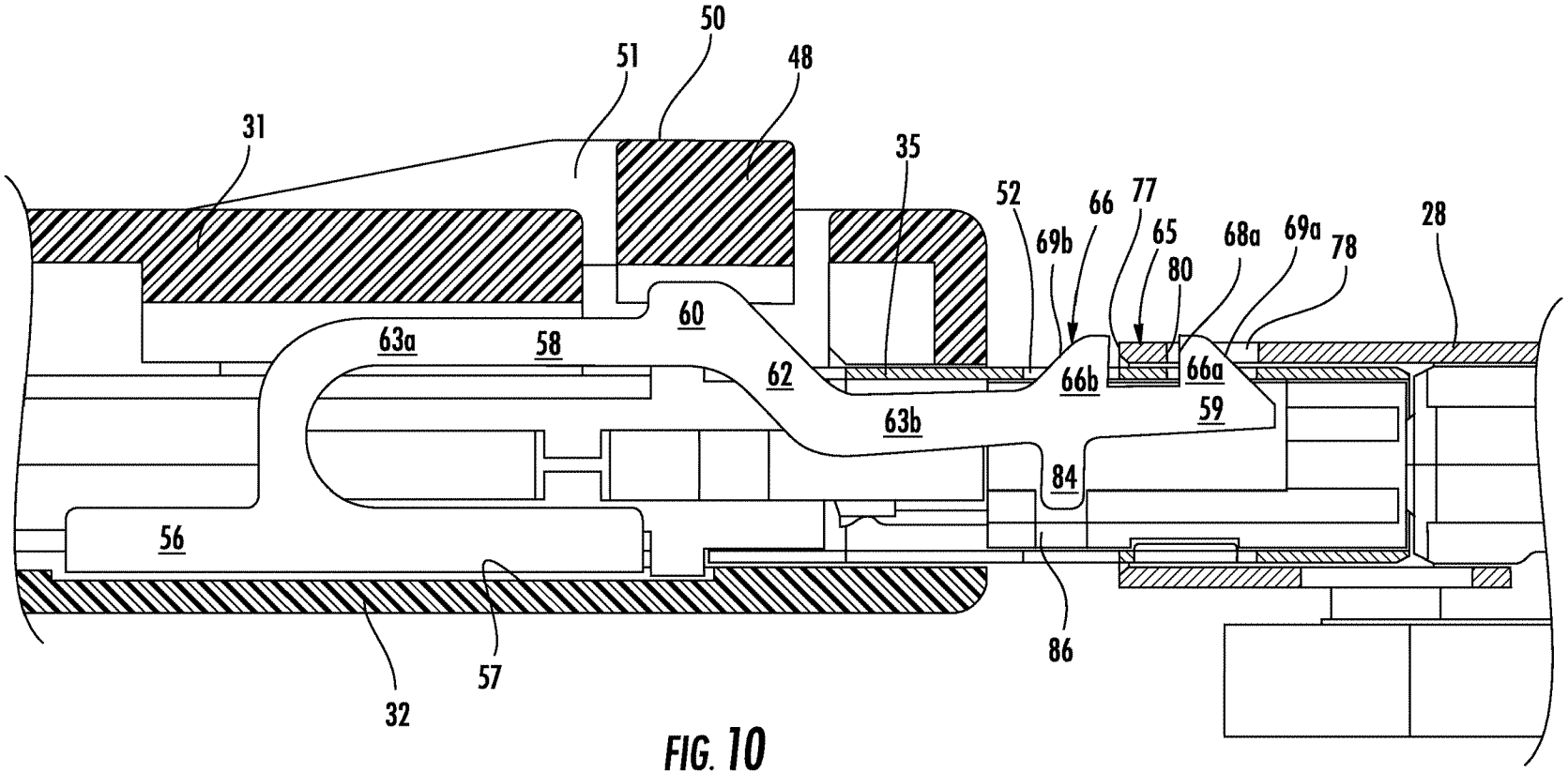
FIG. 10 is an enlarged detail view of FIG. 8.

Turning to FIGS. 4, 9 & 10, it can be seen that the cable connector 22 includes a pair of elongated latching members 56 that are supported on opposite sides of the connector body 34 and which extend through a portion of the connector housing 30 and within the connector shroud 35. The latching members 56 have a base end, or retention portion, 57 that secures the member in place to the connector housing 30. In the embodiment illustrated, the base end 57 is L-shaped and is retained in a slot formed in the connector housing top half 31 that opposes a pair of rails 32*a* of the connector housing bottom half 32. The latching members 56 rise up from the base ends 57 and extend along body, or beam, portions 58 which terminate in free ends 59. The beam portions 58 have an offset configuration 62 that divides the beam portions into top and bottom portions, respectively 63*a*, 63*b*. This offset configuration allows the latching member free ends 59 to extend within the terminal contact area of the connector body 34 that is encircled by the shroud 35.

The latching member free ends 59 include pairs of latching teeth, or hooks, 66 with a leading, or first latch tooth 66*a* and a trailing or second, latch tooth 66*b*. The two latching teeth 66*a, b* of each pair of teeth 66 are separated by an intervening engagement slot, or notch 65 that has a dimension sufficient to accommodate a locking bar, or tab, 82 of the opposing board connector shield 28 therein. In order to provide reliable and positive engagement, the notches 65 include planar sidewalls 68 having respective leading and trailing edges, 68*a*, 68*b*. These edges 68*a*, 68*b* serve as engagement surfaces as they confront like engagement surfaces of the opposing board connector shield 80, 84, as best illustrated in FIGS. 9 & 10. The leading edges 68*a* of the notches 65 serve as stop surfaces that prevent unintended unmating of the two connectors 22, 24 as the cable connector cannot be withdrawn from its mating engagement with the board connector 24 unless the latching member free ends 59 are depressed. Similarly, the trailing edges 68*b* serve as stop surfaces to prevent over insertion of the cable connector 22 into the board connector 24.

The latching member free ends 59 also may include ramped, or cam surfaces 69 that flank the engagement notches 65. The cam surfaces 69 have distinct leading and trailing portions 69*a*, 69*b*. The cam surfaces 69 are shown as having an angled and a flat portion, but it will be understood that they may have continuous angled or arcuate configurations. The cam surfaces 69 communicate with the notches 65 as they are joined at their terminal ends to the notch sidewalls 68*a*, 68*b*. The leading cam surface 69*a* will ride upon the front edge 77 of the board connector shield 28 so that the free end 59 deflects downwardly and the latching tooth 66*a* rides upon the inner surface of the board connector shield 28 until it encounters the board connector shield opening 78 and springs up into that opening.

The notch trailing edge 68*b* confronts the board connector shield front edge 77 and provides a hard stop surface that limits the extent to which the cable connector 22 may be inserted into the board connector 24. Likewise, the engagement notch leading edge 68*a* provides a hard stop that limits the extent to which the cable connector 22 an be unintentionally withdrawn (or unmated) from the board connector 24 as it contacts the board connector shield edge 80. This contact is released when the actuation button is depressed by the user. This mating engagement control is important given the size of the connectors of the present disclosure, equal to or less in size than USB style connectors with terminal pitches of 0.5 mm or less. The leading cam surface 69*a* causes deflection of the latching member free ends 59 without any separate actuation. It can be seen that the notches and the hard stops that they provide control the amount of positive and negative wipe desired for the terminals of the connector assembly 20.

In another embodiment, one or more of the latching members 58 may be provided with a means for locating the latching member 58 along the connector body 34 and controlling the deflection of the latching member free ends 59. The means, as illustrated, include a locating tab 84 that extends at an angle from the latching member beam bottom portion 63*b*. The locating tab 84 is shown as aligned with and positioned underneath the rear latching tooth 66*b* in the Figures but it will be understood that it may be located elsewhere along the latching member body portion 58.

The free end of the locating tab 84 is partially captured in the connector body channel 86 in both the deflected and undeflected conditions of the latching member free ends 59. The locating tab 84 constrains the latching member free ends 59 to substantially vertical movement and prevents unintended horizontal deflection of the latching members due to stubbing as it provides a reaction surface much closer to the free ends 59. Although shown as depending downwardly, the locating tab 84 may extend upwardly dependent on the connector body design.

While preferred embodiments have been shown and described, it is envisioned that those skilled in the art may devise various modifications without departing from the spirit and scope of the foregoing Description and the appended Claims.

What is claimed is:

1. A connector with a bi-directional latching mechanism, comprising:

a housing;

a plurality of terminals supported by the housing, the terminals including tail portions and contact portions for contacting opposing terminals of an opposing, mating connector, the terminal contact portions being disposed proximate to a mating end of the housing;

a shroud formed of a conductive material supported by the housing, the shroud enclosing the terminal contact portions and providing a conductive surface for mating with a shield of the opposing, mating connector; and two latching members supported by the connector housing, each of the latching members including a base that is fixed in place with respect to the housing and a free end extending lengthwise from the base in a cantilevered fashion, the base and the free end being interconnected by an intervening body portion, wherein the latching members each include an actuating tab that extends vertically into contact with an actuation member of the housing such that translation of the actuation member causes the free ends to deflect vertically.

2. The connector of claim 1, wherein each of the free ends including a pair of latching teeth which extend vertically with respect to the latching member body portion, the pairs of latching teeth being separated by a gap, the gap including a leading edge and a trailing edge which extend vertically with respect to the body portion, the trailing edge of the gap defining a stop surface that limits the extent to which the connector can be inserted into mating engagement with the opposing, mating connector, and the leading edge of the gap defining a stop surface that prevents unintended removal of the connector from mating engagement with the opposing, mating connector.

3. The connector of claim 1, wherein the connector shroud includes pairs of openings through which the latching teeth extend.

4. The connector of claim 3, wherein the latching teeth have a height sufficient to project through the connector shroud openings and into engagement with the opposing, mating connector.

5. A connector with a bi-directional latching mechanism, comprising:

a housing;

a plurality of terminals supported by the housing, the terminals including tail portions and contact portions for contacting opposing terminals of an opposing, mating connector, the terminal contact portions being disposed proximate to a mating end of the housing;

a shroud formed of a conductive material supported by the housing, the shroud enclosing the terminal contact portions and providing a conductive surface for mating with a shield of the opposing, mating connector; and two latching members supported by the connector housing, each of the latching members including a base that is fixed in place with respect to the housing and a free end extending lengthwise from the base in a cantilevered fashion, the base and the free end being interconnected by an intervening body portion, the free end including a pair of latching teeth which extend vertically with respect to the latching member body portion, the pairs of latching teeth being separated by a gap, the gap including a leading edge and a trailing edge which extend vertically with respect to the body portion wherein the latching members each include a pair of cam surfaces associated with the latching teeth.

6. The connector of claim 5, wherein the pair of latching teeth included on each of the free ends are separated by a gap, the trailing edge of the gap defining a stop surface that limits the extent to which the connector can be inserted into mating engagement with the opposing, mating connector, and the leading edge of the gap defining a stop surface that prevents unintended removal of the connector from mating engagement with the opposing, mating connector, and wherein the cam surfaces extend from the gap in two directions.

7. The connector of claim 6, wherein the cam surfaces are arcuate.

8. The connector of claim 5, wherein the connector shroud includes pairs of openings through which the latching teeth extend.

9. The connector of claim 8, wherein the latching teeth have a height sufficient to project through the connector shroud openings and into engagement with the opposing, mating connector.

10. A connector, comprising:

a connector housing supporting a plurality of conductive terminals extending lengthwise within the connector housing, each of the terminals including termination portions and contact portions at opposite ends, the terminal contact portions being disposed proximate a mating end of the connector;

at least one latching member for latching the connector to an opposing, mating connector, the one latching member including a base end fixed to the connector housing and a free end proximate the connector mating end, and a body portion interconnecting the one latching member base and free ends such that the one latching member has a cantilevered structure, the one latching member including at least one engagement member proximate to the one latching member free end for engaging a portion of the opposing, mating connector, and wherein the at least one latching member includes an actuating tab that extends at an angle to the latching member body, the actuating tab configured to contact an actuator member associated with the connector housing such that pressure upon the connector housing actuator member causes the at least one latching member free end to move vertically.

11. The connector of claim 10, wherein the at least one latching member includes a locating member extending at an angle from the one latching member body portion, the connector housing including a channel formed therein which receives the one latching member locating member, whereby the connector housing channel is configured to guide the one latching member locating member in vertical movement.

12. The connector of claim 11, wherein the connector housing channel is configured to fix a horizontal location of the one latching member engagement member by constraining horizontal movement thereof.

13. The connector of claim 11, further including a second latching member, the one and second latching members being disposed along opposite sides of the connector.

14. The connector of claim 13, wherein the second latching member includes a base end fixed to the connector housing and a free end proximate the connector mating end, and a body portion interconnecting the latching member base and free ends such that the second latching member also has a cantilevered structure, and the second latching member including an engagement member proximate to the second latching member free end for engaging a portion of an opposing, mating connector.

15. The connector of claim 14, wherein the one and second latching member engagement members include pairs of latching teeth, the latching teeth of each of the pairs being separated by intervening notches, the notches being at least partially defined by a pair of planar, spaced-apart sidewalls.

16. The connector of claim 15, wherein the one and second latching members include ramped surfaces extending lengthwise thereon and extending toward the notches.

17. The connector of claim 16, wherein the ramped surfaces communicate with the notches.

18. The connector of claim 17, wherein the ramped surfaces end at the sidewalls of the notches.

19. The connector of claim 15, wherein the notch sidewalls define pairs of stop surfaces for engaging the opposing mating connector during insertion and removal of the connector therewith.

20. The connector of claim 10, wherein the connector housing channel prevents drifting of the latching member horizontally.

* * * * *